United States Patent [19]

Stephen et al.

[11] 4,352,098

[45] Sep. 28, 1982

[54] SURVEILLANCE SYSTEMS

[75] Inventors: James H. Stephen; John D. McCann; Michael A. Flemming, all of Abingdon, England

[73] Assignee: Parmeko Limited, Leicester, England

[21] Appl. No.: 150,461

[22] Filed: May 16, 1980

[30] Foreign Application Priority Data

May 18, 1979 [GB] United Kingdom ..... 7917347

[51] Int. Cl.[3] ..... G08B 13/14; G08B 13/24

[52] U.S. Cl. ..... 340/572; 340/568; 343/6.5 SS; 455/9

[58] Field of Search ..... 340/572, 568, 565, 567, 340/561-563, 573, 552, 551, 553, 554, 825.54, 825.69, 825.71-825.73; 455/9, 19, 73, 7; 367/90, 93, 94, 95-100; 343/112 R, 6.5 R, 6.5 SS, 113 R, 113 DE

[56] References Cited

U.S. PATENT DOCUMENTS 3,518,546 6/1970 Augenblick et al. ..... 455/19

3,938,125 2/1976 Benassi ..... 340/572

3,990,065 11/1976 Purinton et al. ..... 340/572

4,139,844 2/1979 Reeder ..... 340/572

*Primary Examiner*—John W. Caldwell, Sr.

*Assistant Examiner*—Donnie L. Crosland

*Attorney, Agent, or Firm*—Allison C. Collard; Thomas M. Galgano

[57] ABSTRACT

A surveillance system transmits a microwave carrier signal through a surveillance zone (14). Two low frequency energy fields are also established in the zone being produced by respective pairs of closely spaced apart low frequency signals radiated from opposite sides of the zone. A receptor reradiator in the zones receives these signals and reradiates a reply signal to a receiver the reply signal consisting of the microwave carrier signal amplitude modulated in accordance with the instantaneous value of the low frequency fields at the location of the receptor reradiator. The receiver separates out preselected intermodulation products and activates an alarm only when the preselected intermodulation products are present.

8 Claims, 6 Drawing Figures

10
14

16
16
fc
fc
U.H.F.
U.H.F.
26
fa
fa(+90°)
32
30
22
fa-dfb
T
A
G
fa+dfa
fa-dfb
28
90°
Ø
34
34
fa
UHF ± fa
UHF ± (fa+dfa)
UHF ± (fa-dfb)
UHF ± dfa
UHF ± dfb
UHF ± (dfa ± dfb)
20
24
18
38 UHF PULSE SIDEBANDS
fa+dfa
40
42
36
54
52
H
L
FAR LEFT
I.F. AMP
AGC
L
L
44
CENTRE LEFT
dfa
43
45
57
55
L
L
46
AUDIBLE ALARM
dfa+dfb
41
dfb
L
L
48
CENTRE RIGHT
12
47
FAR RIGHT
X6
X2
H
L
50

SURVEILLANCE SYSTEMS

The present invention relates to surveillance or detection systems for monitoring the position in a checking zone of an article.

Detection systems for detecting the present in a checking zone of an article are primarily used in stores and warehouses for detecting so far as is possible, the unauthorised removal of articles. For this purpose a checking zone is established for example in a store which can be said to be downstream of cash paying points. Each article on sale in the store is provided with a tag which, in the normal course of events, is removed at the paying point but if not so removed, its presence in the detection zone operates an alarm.

Various systems are in use and these broadly fall into two main categories namely magnetic and radio frequency systems. With most magnetic systems the tag incorporates magnetised material the presence of which in the detection zone is detected by magnetic monitoring equipment. This type of system has the disadvantage that the monitoring equipment must be very carefully adjusted otherwise it will either not provide an alarm when required to do so or it may provide a false alarm due to metallic objects normally carried by a person, disturbing the magnetic field.

There are other magnetic systems in which the tag incorporates a battery powered transmitter capable of being triggered by the magnetic field of the surveillance zone. The complex tag required is bulky, heavy and expensive.

Radio frequency systems can be made more sensitive and also reliable and one such system employs a tag having electrical components thereon which pick up energy radiated from a transmitter and by means of a non-linear element, reradiates the energy at twice the frequency of the received radiation. A receiver is provided which is tuned to the frequency of the reradiated signal and when such a signal is detected, an alarm is given. One problem with such a system is the fact that the transmitter may go out of adjustment and radiate a second harmonic signal which will be detected by the receiver and thereby will provide a false alarm. Other faults with such a system can occur.

The present invention provides a method of detecting the presence of an electromagnetic wave receptor reradiotor with signal mixing capability in a surveillance zone comprising the steps of simultaneously radiating first, second and third energy fields through said zone for causing said receptor reradiator to radiate at least one reply signal which is a function of said fields and of the position of the receptor reradiator in the zone, wherein said first energy field is produced by a microwave signal, said second and third energy fields are established respectively from opposite sides of the zone and each is produced by a pair of closely spaced apart signals of relatively low frequencies; and detecting in said zone the presence of said reply signal.

The present invention also provides a surveillance system for detecting the position in a surveillance zone of an electromagnetic wave receptor reradiator with signal mixing capability, comprising first means for transmitting a first microwave signal through said zone; second means for transmitting a first pair of closely spaced apart low frequency signals through said zone; third means for transmitting a second pair of closely spaced apart low frequency signals through said zone, said second and third means being positioned at locations on opposite sides of said zone; signal detecting means for detecting a reply signal which is radiated by a receptor reradiator in said zone and which is a function of said transmitted signals and of the position of the receptor reradiator in said zone; and means coupled to said signal detecting means for energising an alarm means responsively to detection of said reply signal.

The present invention is further described hereinafter, by way of example, with reference to the accompanying drawings, in which.

Figure 1:
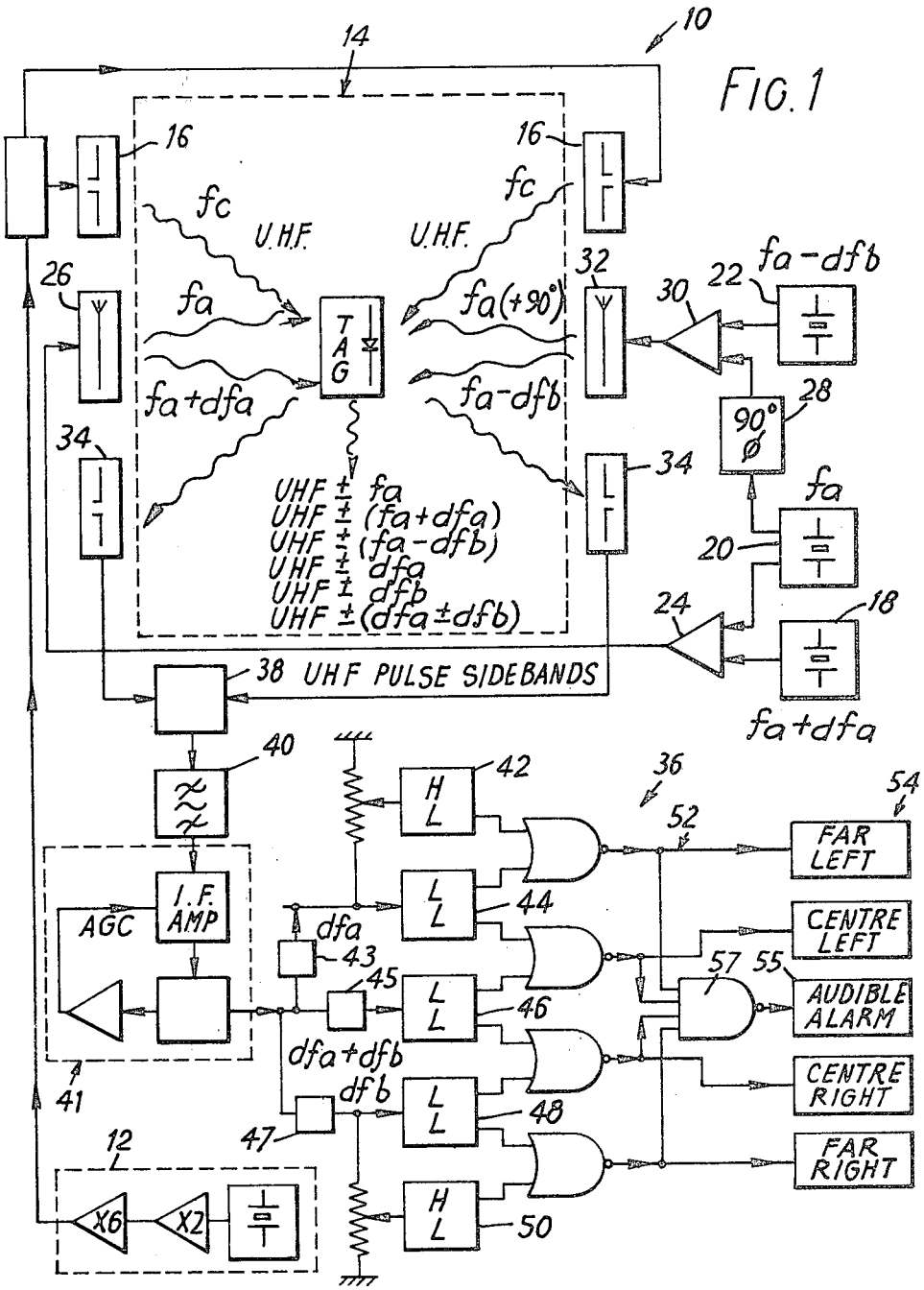
FIG. 1 is a schematic diagram of one embodiment of a system according to the present invention.

U.S. Pat. Nos. 4,302,846 and 4,303,910 describes a detection system in which three different frequencies, one of which is in the region of 900 MHz and the other two of which are in the region 16 to 150 KHz, are transmitted through an area under surveillance, sometimes known as a detection zone. A receptor reradiator in the form of a tag present in the zones receives the three signals and reradiates a signal which is a function of the received signals. A receiver detects the reradiated signal and indicates that a tag is in the detection zone.

A typical system according to the present invention incorporates means for transmitting through an area under surveillance a UHF (ultra high frequency) signal $f_c$, typically 900 MHz, and also means for generating two low frequency fields in the zone using aerials located near the extremities of the zone. Each low frequency field is formed by transmitting a pair of signals of closely spaced frequencies from the same aerial, for example, signals fa and fa+dfa or fa−dfa from one aerial and signals fb together with fb+dfb or fb−dfb from another aerial. The frequencies of signals fa and fb are typically in the region of 100 KHz with the spacing dfa and dfb typically in the range 100 Hertz to 2 KHz.

A suitable receptor reradiator in the form of a marker tag containing a non-linear element would, if placed within the zone i.e. within the influence of the UHF and LF (low frequency) fields, inter-modulate these fields and then reradiate a signal consisting of the UHF carrier signal fc amplitude modulated in accordance with the instantaneous value of the LF fields at the location of the marker tag.

The strength of the signal reradiated from the marker tag will, of course, depend upon the intensity of the combined UHF and LF fields at the marker tag location. The two aerials for generating the LF fields are conveniently located on opposite sides of the zone so that if the tag were located close to one of these aerials then the signal radiated from that aerial would form the major component of the reradiated signal thus providing a means of estimating the position of the tag in the zone. If the tag were located near to the LF aerial driven with signals fa and fa+dfa then the predominant demodulation products detected by a suitable receiver of the system would be at these frequencies fa and fa+dfa. These demodulation products would be processed by the receiver as separate frequencies beating in and out of phase with one another at a beat frequency dfa. This beat frequency dfa can be recovered for example by using a simple diode detector.

The beat frequency signal dfa may be selected out of any background noise by means of a phase-locked loop tone decoder. By this means, where a continuous component of signal dfa is present the receiver will indicate that a tag is present in the detection zone.

If the tag were located near to the LF aerial driven with signals fb and fb+dfb then these signals would be the predominant demodulation products detected by the receiver. Again, where the tag is approximately midway between the LF aerials then the beat frequencies dfa and dfb would have similar amplitudes. It is therefore obvious that this relationship between the two signals dfa and dfb can be used to provide a ready indication of the position of a tag in the detection zone.

However, if the above-mentioned pairs of frequencies are used on the LF aerials a tag which is located near the mid position of the surveillance zone and thus approximately half way between the two aerials would give rise to numerous intermodulation products of the signals fa, fa+dfa fb and fb+dfb. This could result in processing problems in the receiver but because tag location can be deduced from the strength of the beat frequencies dfa and dfb the system may be simplified by making the signal frequency fa equal to fb but retaining different values for the frequencies of signals dfa and dfb so that the transmitted signals fa+dfa and fa+dfb would not be of the same frequency. This simplification of the system gives rise to a number of advantages such as the following:

1. The number of intermodulation products generated and reradiated by the tag is greatly reduced and this in turn considerably simplifies processing of the signals in the receiver.

2. A single intermediate frequency amplifier channel of conventional band width is able to handle simultaneously all the intermodulation products reradiated by a tag. This simplifies receiver design and therefore reduces costs.

3. A tunes pre-amplifier may be used in front of the main intermediate frequency amplifier. This reduces the system noise in the reciver and therefore the likelihood of the receiver responding to false signals.

4. Detectors such as tone detectors used in the receiver operate at very low frequencies i.e. the frequencies of signals dfa and dfb. These frequencies are thus well removed from that of the intermediate frequency amplifier thus reducing interaction between circuit elements and in particular reducing the possibility of radiation from a detector oscillator entering the intermediate frequency amplifier.

5. The logic and sensing circuits for indicating the position of a tag in the detection zone can be simplified and made smaller, thus making them easier to screen and cheaper to manufacture.

6. The LF aerial systems operate over the same narrow band of frequencies and may therefore be manufactured as identical units.

7. If it is arranged that the common low frequency fa is applied to the LF aerials in such a menner that the fields produced by each aerial differ in phase by 90° then the pattern developed between the aerials will exhibit rapid cyclic changes. The movement in the pattern will mean any regions of low sensitivity will also move and on average detection of a tag will be more certain.

FIG. 1 shows a system 10 in which a UHF transmitter 12 generates a high frequency signal fc, typically 900 MHz, which is radiated through a detection zone 14 by two aerials 16 disposed on opposite sides of the zone 14. In this system the two main low frequency signals which are transmitted through the zone 14 are at the same frequency fa (although it will be appreciated as mentioned above that two different frequencies fa and fb could be used) and the two further transmitted signals are fa+dfa and fa−dfb thus giving two pairs of signals, fa and fa+dfa, and fs−dfb. The three signals fa+dfa, fa and fa−dfb are generated for example by three respective crystal oscillators 18, 20 and 22. The two signals fa and fa+dfa are amplified through a common amplifier 24 and radiated from aerial 26. The signal fa is also passed through circuit 28 which alters the phase of the signal through a suitable angle but preferably by 90°. This phase altered signal fa (+90°) is amplified together with the signal fa−dfb in a common amplifier 30 and then radiated from aerial 32. The aerials 26 and 32 are conveniently located on opposite sides of the detection zone 14. If signals fa and fb of different frequencies were used the signals fa and fa+dfa would conveniently be transmitted from one side of zone 14 with the signals fb and fb+dfb transmitted from the other side. The difference signals fa−dfa and fb−dfb could be used in addition to or alternatively to the signals fa+dfa and fb+dfb.

If a suitable tag is present in the detection zone the tag receives the five signals radiated through the zone: fc, fa, fa (+90°), (fa+dfa) and (fa−dfb), mixes these signals and reradiates intermodulation products. A suitable receptor reradiator comprises a half wave dipole having a non-linear element such as a diode intermediate between its ends.

The intermodulation products produced by the tag contain frequencies of fa, fa+dfa and fa−dfb on either side of the UHF signal frequency fc. Depending upon the relative strength of the fields at the tag, the family of frequencies could contain most or all of the following:

fc±fa
fc±(fa+dfa)
fc±(fa−dfb)
fc±dfa
fc±dfb
fc±(dfa+dfb)

If the label were in a part of the detection zone where the signal fields were strong then intermodulation products at multiples of fa, dfa, dfb, fa+dfa, fa−dfb and dra+dfb would also be produced.

One or more receiver aerials 34 are located in the detection zone and are coupled to a detector 38 of a receiver 36. The detector recovers the three retransmitted sideband signals fa+dfa, fa and fa−dfb from the received UHF signal. These three signals then pass through a narrow bandwidth filter 40 and, after amplification, to a further detector 41 which selects the three preferred signals, in this instance dfa, dfa+dfb and dfb. This detector 41 includes an amplifier **41*a* whose gain is automatically controlled in known manner through a feedback loop 41*b*. Although the intermodulation product of dfa+dfb is used here the difference signal dfa−dfb may be preferred. In this instance the initially radiated signals would need to be chosen to ensure that the tag reradiated the intermodulation product fc±(dfa−dfb) as a result of mixing the signals fc, fa+dfa and fa+dfb received by the tag. These three signals are then applied separately through respective narrow passband filters 43, 45 and 47 to a number of triggers 42, 44, 46, 48 and 50 in the form of tone decoders. The signal dfa is applied to triggers 42 and 44, one of which responds to a high level of signal dfa. Signal dfb is applied to triggers 48 and 50, trigger 50 responding also to a high level signal dfb. The signal dfa+dfb is applied to trigger 46 which responds to a low level signal. These triggers 42 to 50 are conveniently phase locked to ensure an output only when a continuous input signal at the correct frequency and level is received. The outputs of these triggers 42 to 50 are coupled via further logic circuits 52 to suitable means 54 for indicating the relative position of the tag within the detection zone. These indicator means may conveniently be a row of lamps each of which represents a particular position in the detection zone and which is lit in dependence upon the particular combination of signals generated by the triggers 42 to 50 and acted upon by the logic circuitry 52**.

Audible indicator means may alternative or additionally be provided, conveniently a different tone signal indicating respective positions in the detection zone. In its simplest form this would be an alarm 55 triggered through the logic circuits 52.

Figure 2:
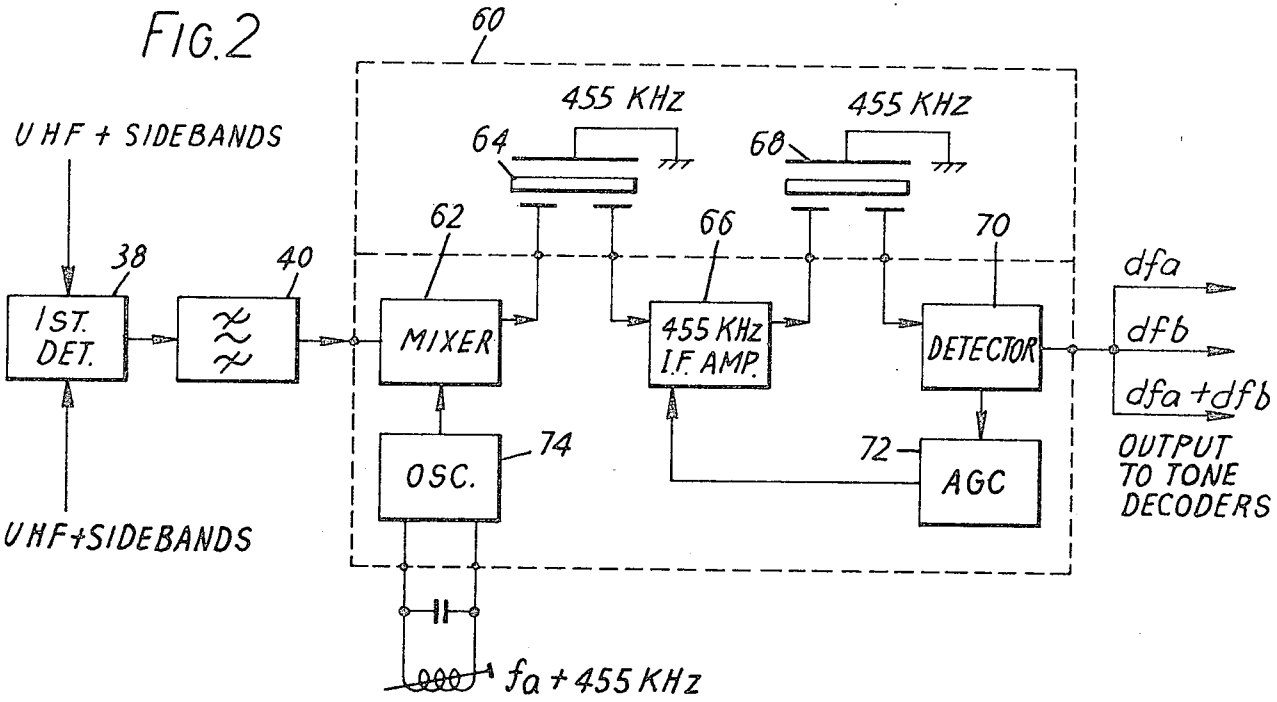
FIG. 2 is a schematic diagram of a modified form of receiver for the system of FIG. 1.

In a modification of the described system the detector 41 of FIG. 1 may be replaced by the circuit 60 shown in FIG. 2. Where two or more surveillance systems such as is illustrated in FIG. 1 are used near one another, for example in a large department store, there is the possibility of one system interferring with another and causing spurious alarms. In order to avoid such interference between nearby systems a different low frequency fa may be chosen for each system. However, to avoid having to use a different receiver circuit in each system to cater for the different frequencies used the receiver circuit of FIG. 2 may be used. The circuit 60 is a typical IF (intermediate frequency) amplifier circuit which includes a mixer 62, a narrow band ceramic filter 64, an IF amplifier 66, a further narrow band ceramic filter 68 and a detector 70 all connected in series with the output of the detector being connected to the triggers 42 to 50 of the circuit of FIG. 1. The circuit 60 also includes an automatic gain control (agc) circuit 72 to control the gain of the IF amplifier and an ascillator 74 connected to the mixer 62. A typical intermediate frequency for the circuit 60 is 455 KHz and the oscillator is therefore set to 455+fa KHz.

The incoming signals fa, fa+dfa and fa−dfb are mixed with the oscillator signal in the mixer 62 and passed through the circuit 60. At the detector 70 the signals dfa, dfb and dfa+dfb are selected and applied to the triggers 42 to 50 as previously described through the filters 43, 45 and 47.

Any suitable filters may be used for the filters 64 and 68.

The low frequencies used in the above-described systems may conveniently be chosen in the range 16 KHz to 150 KHz with a suitable frequency fc in the near microwave or microwave frequency band.

A serious complaint with many security systems is that if adjusted to be sensitive, they also have a high false alarm rate. Such a defect destroys confidence in the system and can also have embarrassing consequences. In many instances, however, the false alarm is not due to an equipment fault but arises from locally generated electrical interference such as produced by electrical tools and intermittent electrical contact between metallic objects, for example bunches of keys.

Such interference is generally broadband in nature in contract with signals produced by the present system labels which are at discrete frequencies determined by the transmitter of the system. Such broadband interference could therefore be distinguished from label generated signals by the use of an additional channel in the receiver. The additional channel could be tuned to the frequency of one of the selected intermodulation products detected by the receiver, such as fa+dfa, fa and fa−dfb in the embodiment of FIG. 1 but with a considerably broader bandwidth than the corresponding receiver channel, for example five times the bandwidth. In the absence of broadband noise a label signal would generate the same signal in both the additional channel and the corresponding receiver channel but the ratio of signal strengths produced by broadband noise interference would be in the ratio of the channel bandwidths i.e. 5:1. This difference in signal strength could be used to inhibit the receiver and present such interference triggering a false alarm.

The additional channel may of course be tuned to an unused frequency and would not therefore respond to label generated signals.

The use of an additional channel in the form described above would not, however, recognise interference in the form of a single beat note resulting from the intermodulation of carrier waves from local and neighbouring equipment. A pair of carrier waves beating together might not produce an alarm signal in the system of FIG. 1 but could affect automatic gain control circuits in the receiver and thus reduce the overall sensitivity of the system.

In the system of FIG. 1 each low frequency aerial 26, 32 produces excitation fields consisting of a pair of closely spaced frequencies. In the described system these are fa, fa+dfa and fa, fa−dfb. The separate signals of each pair of frequencies beat together causing the excitation field to vary in amplitude at the beat frequency, typically a few hundred Hertz. The detector 41 in the receiver reduced this envelope to a D.C. voltage varying at the beat frequency, i.e. it produces a signal whose frequency is the beat frequency of a few hundred Hertz. A genuine signal can thus be recognized by the logic circuit of the receiver acting when at least a given level of DC voltage is present together with a predetermined minimum AC signal at the known beat frequency.

An interferring carrier wave, which is in the frequency band likely to upset the normal performance of the surveillance system, from, for example, a neighbouring system although mixing in the first detector 38 of the receiver 36 with the signals from the label normally received by the receiver 36 to yield a product within the IF passband of the receiver, will generate only a D.C. component at the output of the detector 41.

Figure 3:
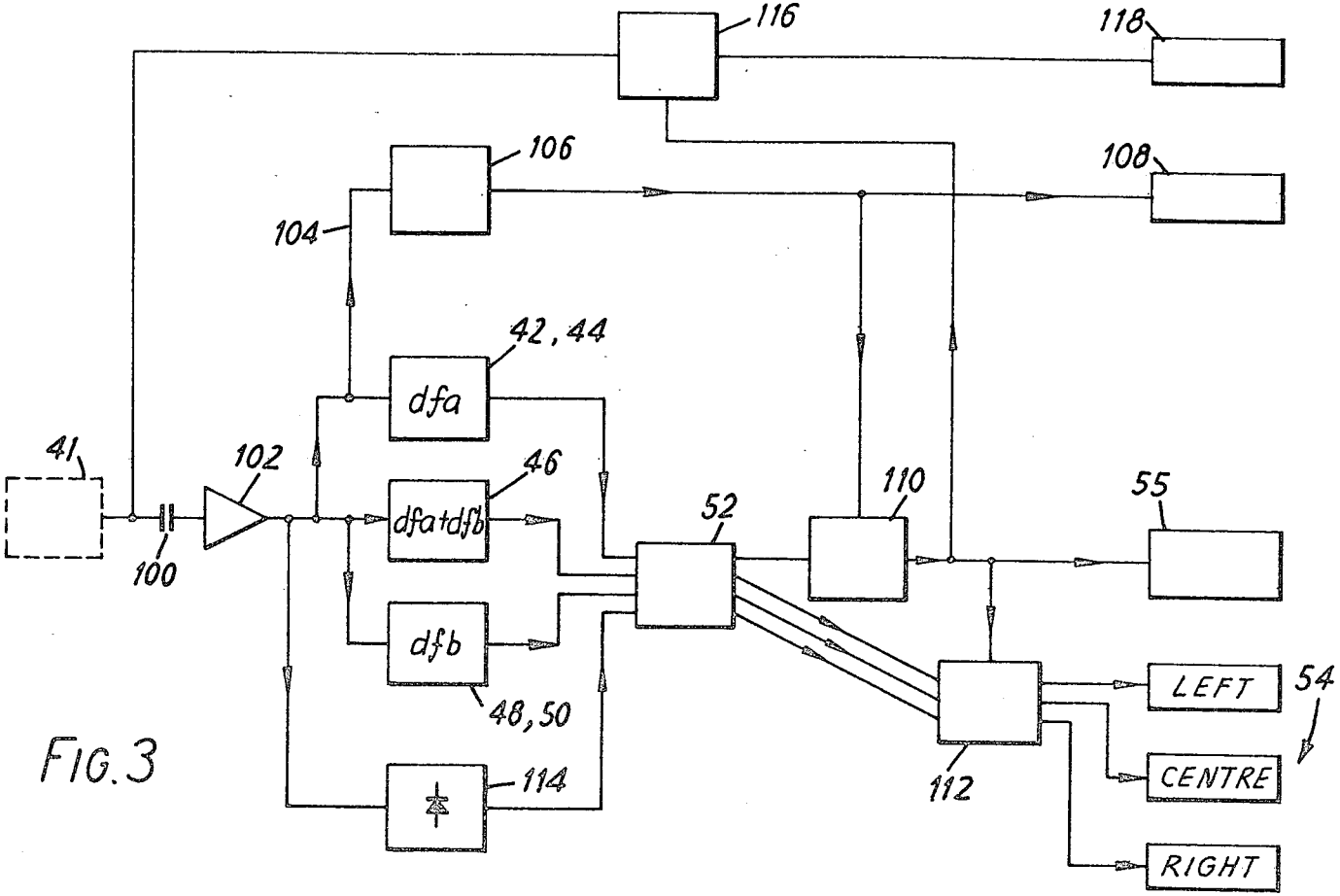
FIG. 3 is a schematic diagram of a further modified form of receiver for the system of FIG. 1.

FIG. 3 illustrates a logic circuit which detects this D.C. component at the output of the detector 41, processes this as a fault condition and provides an appropriate warning for an operator. The logic circuit of FIG. 3 is a modification of the circuit of FIG. 1 and like parts are given like reference numbers.

The detector 41 is coupled through a capacitor 100 and amplifier 102 to the tone decoders 42 to 50. Under normal operating conditions the tone decoders 42 to 50 control the alarm 55 and position indicating lamps 54 through the logic circuit 52. However, the circuit of FIG. 3 also includes the additional channel 104 mentioned above for detecting the presence of broadband interference. This channel 104 is connected in parallel with the tone decoder channels and includes a wideband noise detector 106 which, as mentioned above has a much broader bandwidth than any of the tone decoder channels and may be tuned to one of the desired frequencies, in this example dfa, dfb and dfa+dfb. The output from the noise detector 104 controls an indicator 108 for indicating the presence of wideband noise and also an inhibit circuit 110 connecting the logic circuits 52 to the alarm 55. Under normal conditions the inhibit circuit 110 does not inhibit signals from the logic circuits 52 to the alarm 55.

The logic circuits 52 are also coupled to the position indicating lamps 54 by way of a gating circuit 112. The gating circuit 112 is opened by a signal passing from the logic circuits 52 to the alarm 55 to enable the position indicator lamps 54.

A level detector 114, for example a Schmitt trigger, is also connected to the output of the amplifier 102. This detector 114 detects the D.C. level which is present at the output of the detector 41 whenever one of the preselected tone signals (dfa, dfb and dfa+dfb) is received and enables the logic circuits 52 to activate the alarm 55 and position indicating lamps 54. Thus the logic circuits 52 provide a signal when one of the tone decoders indicates the presence of one or more selected beat frequency signal in conjunction with a given minimum D.C. level at the output of the detector 41.

Wideband noise which might cause both the tone decoders and the level detector 114 to generate a false signal and trigger the alarm is sensed by the noise detector 106 which in turn activates the inhibit circuit 110. As will be appreciated by those skilled in the art, where the noise detector 106 is tuned to one of the tone decoder signal frequencies its operation may be inhibited on receipt of a discrete tone decoder signal.

In addition to the wideband noise detector 106 a spurious signal detector 116 is also connected to the output of the detector 41 and controls a further warning device such as a lamp 118. The spurious signal detector 118 is a frequency selective circuit such as a tone decoder which is tuned to a frequency which would not be generated by the detection system when operating normally but might be generated by interference from nearby systems or equipment. When such an interference signal appears at the outpout of the detector 41 the detector 116 energizes the lamp 118 to warn the operator of the presence of such interference and the possibility that, for example, the receiver sensitivity may be reduced.

A wanted signal processed by the logic circuits 52 and applied to the alarm 55 is also used to inhibit the detector 116 and thus avoid confusing the operator with both alarms 55 and 118 being energised.

The preferred detection system is of course intended for continuous operation over a long period of time but in practice would give an alarm only at very infrequent intervals. Since the frequency of genuine alarms may be low it is possible that a malfunction of the system may not be discovered for some time. To avoid this possibility the preferred system includes an automatic checking facility which tests the system.

Figure 4:
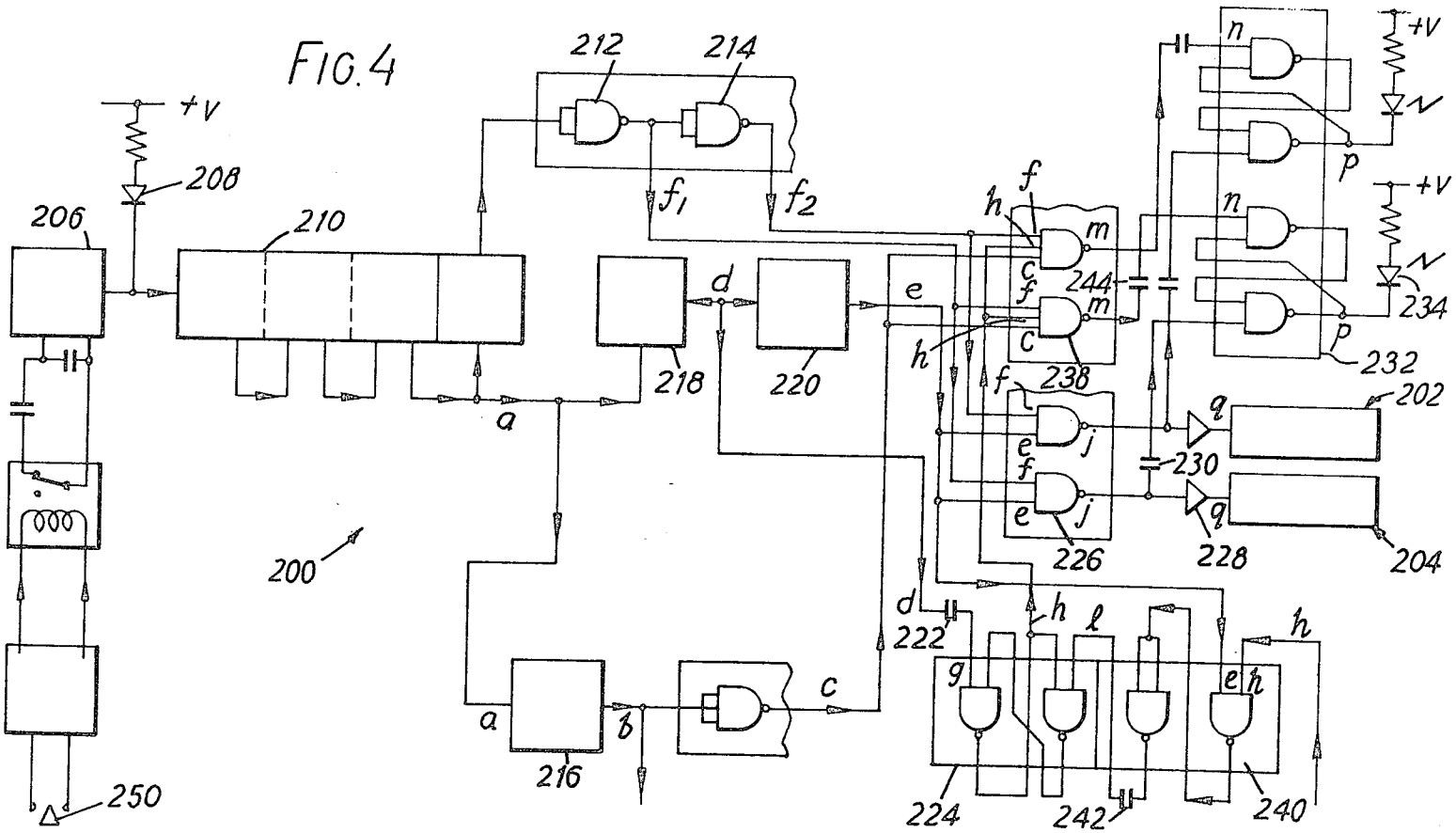
FIG. 4 is a diagram of a checking circuit for automatically testing the surveillance system.
Figure 6:
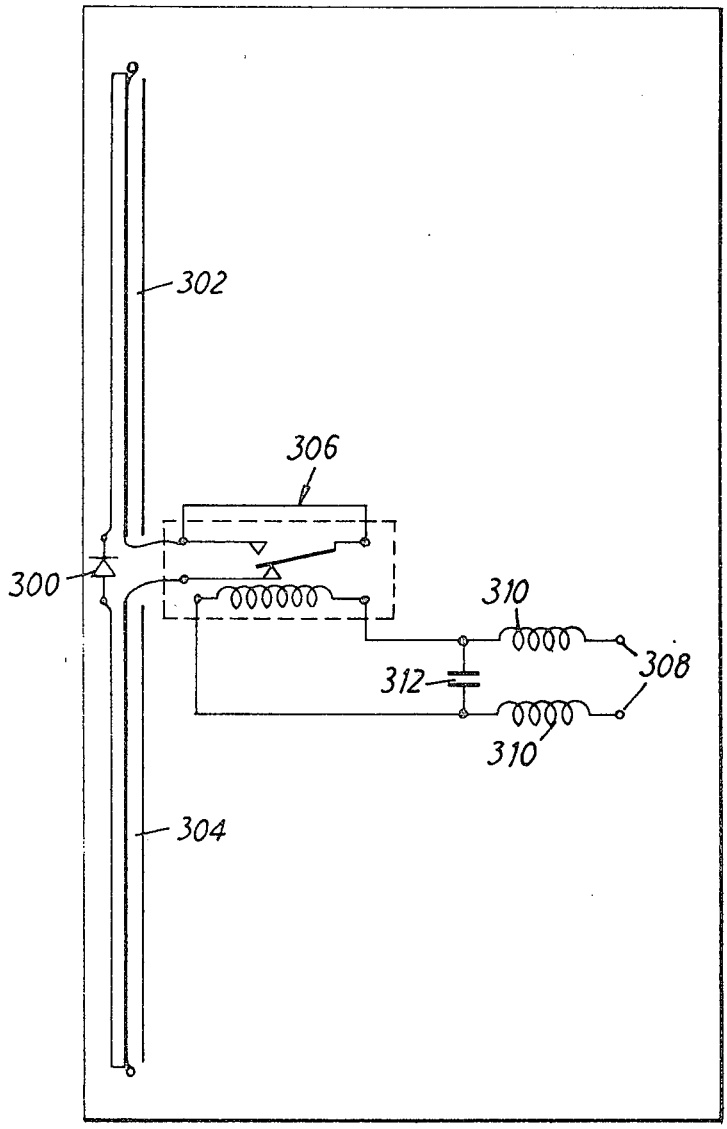
FIG. 6 is a diagram of a dummy receptor reradiator for the circuit of FIG. 4.

FIG. 4 schematically illustrates a checking circuit 200 which cooperates with two dummy labels 202 and 204 arranged on respective sides of the surveillance zone 14. Each label is alternately activated to simulate a genuine label in the zone 14 and thus test the adjacent receiver and transmitter aerials and associated circuitry. In this preferred system the dummy labels are alternately activated approximately every 30 minutes although this can of course be varied to suit individual requirements. A form of dummy label is illustrated in FIG. 6.

Figure 5:
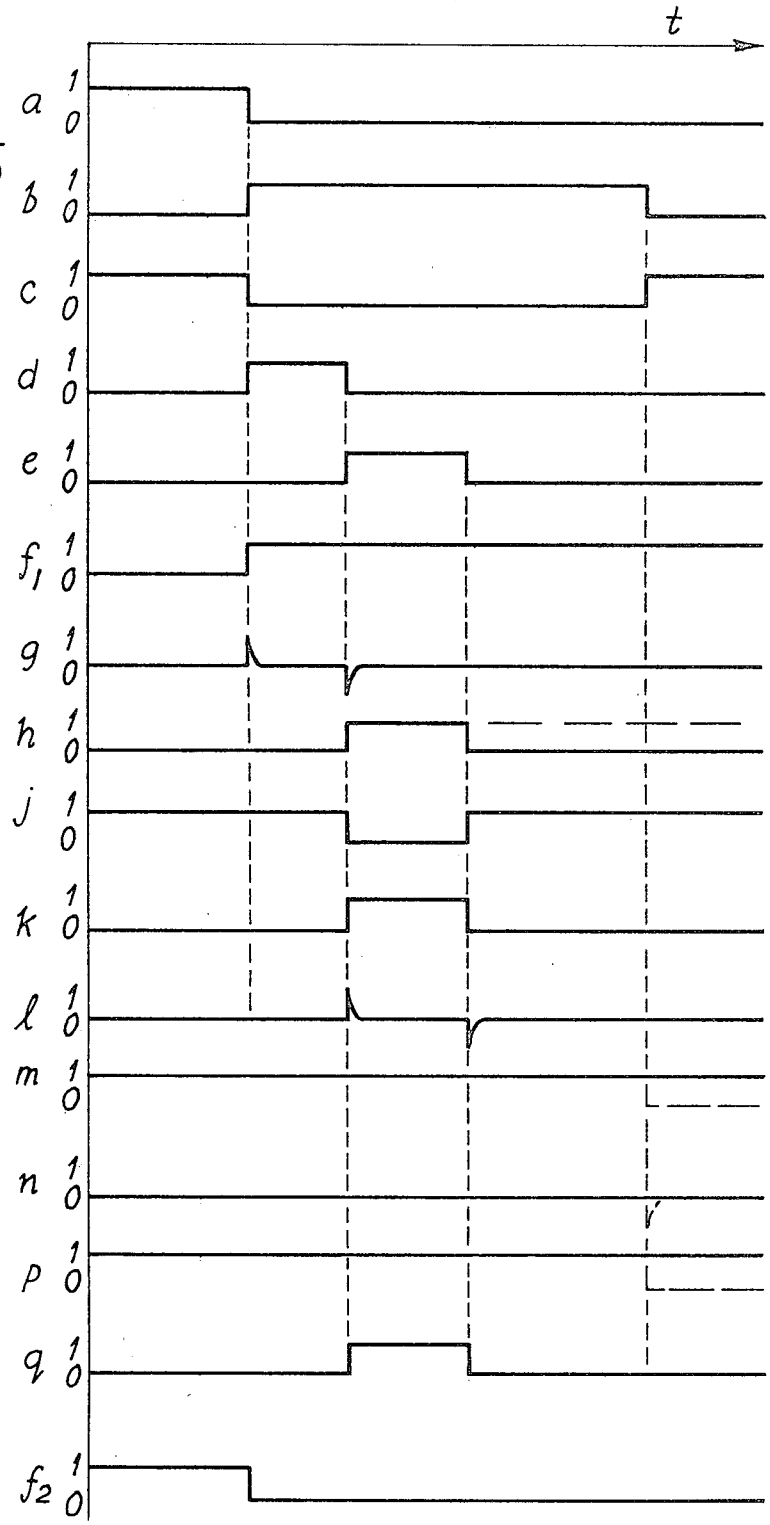
FIG. 5 is a pulse waveform diagram for the circuit of FIG. 4.

FIG. 5 illustrates the pulse waveforms at various points in the circuit of FIG. 4 identified by the reference lower case letters of FIG. 5.

The circuit of FIG. 4 has a master astable oscillator 206 whose period is normally approximately 36 seconds. A light emitting diode 207 coupled to the output of the oscillator 206 provides a visual indication that the oscillator is operating correctly. The output signal from the oscillator is divided down in a divider 210 to provide on a pulse train whose period is approximately 30 minutes thus providing a negative going pulse with a leading edge as shown in FIG. 5*a* every 30 minutes. The pulse train is further divided by 2 in the divider 210 and applied to two series connected inverters 212 and 214. The inverter 212 produces the pulse $5f_1$ which enables activation of the dummy label 202 on the left side of the zone 14 while the inverter 214 produces the pulse $5f_2$ to prevent activation of the right dummy label 204. After a lapse of 30 minutes a further negative going pulse 5*a* reverses the pulses $5f_1$ and $5f_2$ to activate the right dummy label 204 and complete a full system test.

The pulse 5*a* is applied to a monostable multivibrator 216 which produces a 2 second pulse 56 which is used to inhibit the system alarm 55 and lamps 54 during the test. The pulse 5*a* is also applied to a further monostable multivibrator 218 which generates a "pre-check" pulse 5*d* of approximately 0.5 seconds. The trailing edge of this pre-check pulse 5*d* triggers a further monostable 220 which generates a check pulse 5*e* of approximately 0.6 seconds duration and is also differentiated by capacitor 222 to apply a negative going spike 5*g* to a bistable multivibrator 224 and switch its output from a lagic 0 state to a logic 1 state (FIG. 5*h*).

The output of the monostable 220 and the output of the inverter 212 are connected to respective inputs of a NAND gate 226. Coincidence of the logic 1 starts at the inputs of the NAND gate 226 generates a logic 0 output (FIG. 5*j*) which is inverted by an inverter 228 to energise the right dummy label 204 with a pulse 5*q*. The pulse 5*j* is also differentiated by capacitor 230 and applied to a bistable multivibrator 232 which controls a light emitting diode 234 which, when illuminated, indicates a failure in the system. The differentiated pulse 5*j* sets the output of the bistable at logic 1 (FIG. 5*p*). This is necessary since if a previous test had indicated a failure the output of the bistable 232 would be at logic 0.

An inverter 236 inverts the pulse 56 to form pulse 5*c* and applies this to one input of a NAND gate 238, the other inputs of which are connected to receive pulses 5*f*, and 5*h*. Because of the timing of these pulses 5*c*, 5*f*, and 5*h* at no time before and during the 2*s* pulse 5*c* are all of the inputs of the NAND gate at logic 1. The input therefore is at logic 1 as shown by 5*m*.

Should the detection system function correctly on activation of the right label 204 a short durection pulse 5*k* may be derived from the system receiver and applied through a coincidence gate 240 and a differentiating capacitor 242 to an input of the bistable 224. The negative going differentiated pulse 51 terminates the pulse 5*h* so that even after the 2 second pulse 5*c* ends the outputs of the NAND gate and the bistable 232 remain at logic 1 with the diode 234 off. If, however, the detection system fails to generate an alarm signal for the alarm 55 or lamps 54 no pulse 5*h* is produced and the output of the bistable 224 remains at logic 1 as shown by the dotted lines in FIG. 5*h*.

Thus when the 2 second pulse 5*c* ends all three inputs of NAND gate 238 are at logic 1 and its output switches to logic 0 (shown in dotted lines in FIG. 5*m*). The pulse thus generated is differentiated by capacitor 244 to switch the output of bistable 232 to logic 0 and illuminates the diode 234 indicating a failure of the detection system.

The left label 202 is activated in the same manner as described above.

In order to assist engineers inspecting the system provision is made for the frequency of the oscillator 206 to be increased for an observation period of for example 40 seconds following the closing of a test button 250. During the observation period the frequency with which the fault checking circuit tests the system is increased during this observation period to a preselected cycle of, for example 4 seconds instead of the standard frequency of 1 hour.

FIG. 6 illustrates one example of a label which may be used ad a dummy label 202 and 204. The label has an aerial which is essentially a half-wave dipole with a high-frequency semiconductor diode at its centre. So that the label may be desensitized during normal operation of the detection system voltage from the low frequency fields generated in the surveillance zone must not be allowed to appear across the diode 300. In addition, the manner in which the label is desensitized should not adversely affect the label performance when it is activated during a test period. The arms 302, 304 are conveniently made from coaxial cable. The diode 300 is connected across the outer conductors of the two arms while the outer and inner conductors are short circuited together at the ends of the arms remote from the diode 300. A relay 306 is connected across the free ends of the inner conductors and does not degrade the high frequency performance of the dummy label during test periods. The contents of the relay 306 are normally closed to desensitize the lable during normal operation of the detection system, the contact being opened by a drive pulse applied to input terminals 308 from the inverters 228. A filter comprising two series inductances 310 and a parallel capacitor 312 present a high impedance at UHF and allows the relay to be operated by a drive pulse conveyed along the aerial cable of the aeriels 16 thus reducing installation costs.

We claim:

1. A method of detecting the presence and position in a surveillance zone of an electromagnetic wave passive receptor reradiator with signal mixing capability, comprising the steps of simultaneously radiating first, second and third energy fields through said zone for causing said receptor reradiator to radiate at least one reply signal which is a function of said energy fields, wherein said first energy field is produced by a microwave signal, said second and third energy fields are produced by low frequency signals relative to said microwave signal, said second energy field is produced by continuously radiating a first pair of closely spaced apart signals and said third energy field is produced by continuously radiating a second pair of closely spaced apart signals, said second and third energy fields being radiated into said zone at spaced apart locations adjacent the edges of said zone, and said reply signal is the function of the position of said receptor reradiator; detecting in said zone the presence of said reply signal; indicating the position of the receptor reradiator in the zone; and triggering an alarm in response to detection of said reply signal.

2. A method as claimed in claim 1 wherein a signal of one of said pairs of signals is at the same frequency as and out of phase with a signal of the other of said pairs of signals.

3. A surveillance system for detecting the presence and position in a surveillance zone of an electromagnetic wave passive receptor reradiator with signal mixing capability comprising in combination: first means for generating a microwave signal; means coupled to said first generating means for radiating through said zone a first energy field corresponding to said microwave signal; second means for generating a first pair of continuous closely spaced apart signals; means coupled to said second generating means for radiating through said zone a second energy field corresponding to said first pair of signals; third means for generating a second pair of continuous closely spaced apart signals; means coupled to said third means for radiating through said zone a third energy field corresponding to said second pair of signals, wherein said second and third pairs of signals are at low frequencies relative to the microwave signal; a receptor reradiator operable to detect said energy fields and to radiate a least one reply signal which is a function of said signals; said means radiating said second and third energy fields being positioned respectively at spaced apart locations adjacent the edges of said zone, said reply signal being a function of the position of said receptor; a receiver for detecting said reply signal; means controlled by the receiver in dependence upon the detection of said reply signal to indicate the position of the receptor reradiator in said zone; and an alarm coupled to the receiver for providing an alarm signal responsive to the receiver detecting the reply signal.

4. A surveillance system as claimed in claim 3 wherein one signal of each pair of signals is at a frequency in the range 16 KHz to 150 KHz and the signals of each pair are spaced apart between 100 Hz and 2 Khz.

5. A surveillance system as claimed in claim 4 wherein one signal of one of said pairs is at the same frequency as and out of phase with a signal of the other of said pairs of signals.

6. A surveillance system as claimed in claim 5 wherein said one signal is 90° out of phase with said other signal.

7. A surveillance system as claimed in any of claim 3 further comprising inhibit means coupled to the signal detecting means for detecting the presence of preselected interference signals detected by said detecting means as reply signals and operable to inhibit said alarm means responsively to the presence of said interference signals.

8. A surveillance system as claimed in any of claim 3 further comprising means for testing the operability of said system, said testing means comprising at least one dummy receptor reradiator positioned in said zone, a drive circuit for activating said dummy receptor reradiator for a preselected time period, means for inhibiting said alarm means during said time period, means coupled to said energizing means for indicating a failure of said surveillance system in the absence of said energising means applying an alarm signal to said alarm means within said preselected time period.

* * * * *